US007712445B2

(12) United States Patent
Ma et al.

(10) Patent No.: US 7,712,445 B2
(45) Date of Patent: May 11, 2010

(54) FUEL PRESSURE BOOST METHOD AND APPARATUS

(75) Inventors: Qi Ma, Farmington Hills, MI (US); William C. Albertson, Clinton Township, MI (US); Frederick J. Rozario, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/930,735

(22) Filed: Oct. 31, 2007

(65) Prior Publication Data

US 2008/0276910 A1 Nov. 13, 2008

Related U.S. Application Data

(60) Provisional application No. 60/865,006, filed on Nov. 9, 2006.

(51) Int. Cl.
*F02M 1/16* (2006.01)
*F02D 41/06* (2006.01)
*F02M 1/00* (2006.01)

(52) U.S. Cl. ..... 123/179.1; 123/179.17

(58) Field of Classification Search ..... 123/179.25, 123/179.31, 179.1, 497, 179.16, 179.17, 123/510, 511

See application file for complete search history.

(56) References Cited

U.S. PATENT DOCUMENTS 4,270,410 A * 6/1981 Herscovici ..... 74/665 Q
4,406,951 A * 9/1983 Inoue ..... 307/10.1
4,676,204 A * 6/1987 Inoguchi et al. ..... 123/179.16
4,893,593 A * 1/1990 Sejimo et al. ..... 123/179.9
5,072,704 A * 12/1991 Webb ..... 123/179.1
5,165,371 A * 11/1992 Wada et al. ..... 123/179.15
5,884,597 A * 3/1999 Hiraku et al. ..... 123/179.17
6,058,912 A * 5/2000 Rembold et al. ..... 123/516
6,553,966 B2 * 4/2003 Cornell et al. ..... 123/446
6,615,786 B2 * 9/2003 Mori et al. ..... 123/179.31
6,694,951 B2 * 2/2004 Frank ..... 123/495
6,705,266 B2 * 3/2004 Tachikawa et al. ..... 123/179.3
6,758,181 B2 * 7/2004 Iida et al. ..... 123/179.24
6,907,857 B2 * 6/2005 Saito et al. ..... 123/299
7,066,126 B2 * 6/2006 Tokuyasu et al. ..... 123/179.17
7,357,105 B2 * 4/2008 Moriwaki et al. ..... 123/90.12
7,370,619 B2 * 5/2008 Berger ..... 123/179.25
2001/0011537 A1 * 8/2001 Joos et al. ..... 123/497
2004/0206337 A1 * 10/2004 Tokuyasu et al. ..... 123/497
2006/0162324 A1 * 7/2006 Pott et al. ..... 60/299
2007/0199529 A1 * 8/2007 Deane ..... 123/90.16

(Continued)

FOREIGN PATENT DOCUMENTS

KR 10-0170926 B1 1/1999

(Continued)

OTHER PUBLICATIONS

Anonymous, An Arrangement for Fuel System Priming with Spark, Ignition Direct Fuel Injection, General Motors Research Disclosure, (cont.) Pub. No. 502090, Feb. 2006.

*Primary Examiner*—Stephen K Cronin
*Assistant Examiner*—Sizo B Vilakazi

(57) ABSTRACT

An apparatus for providing pressurized fuel for an engine includes an engine starting apparatus including an electric motor operative to crank the engine and a fuel pump operatively coupled to the electric motor.

12 Claims, 4 Drawing Sheets

U.S. PATENT DOCUMENTS

2008/0022982 A1* 1/2008 Kamiyama ..... 123/575
2008/0218105 A1* 9/2008 Wunderlich ..... 318/362
2008/0276910 A1* 11/2008 Ma et al. ..... 123/497
2009/0107442 A1* 4/2009 Ma et al. ..... 123/179.17

FOREIGN PATENT DOCUMENTS

KR 10-2006-0073776 A 6/2006

* cited by examiner

FUEL PRESSURE BOOST METHOD AND APPARATUS

CROSS REFERENCE TO RELATED APPLICATIONS

This application claims the benefit of U.S. Provisional Application No. 60/865,006 filed on Nov. 9, 2006 which is hereby incorporated herein by reference.

TECHNICAL FIELD

The present disclosure is related to internal combustion engine fuel delivery.

BACKGROUND

During engine starting events, a fuel rail operative to channel pressurized fuel to the engine may not have enough pressure to deliver fuel in quantity and quality required to accurately meet engine fuel demands due to an increased response time of the fuel pump and system. This is particularly acute in all direct injection engines which rely on cam driven fuel pumps to establish the high pressures required for direct in-cylinder fuel injection. Such high pressure fuel pumps struggle to achieve adequate pressure at the typically low engine cranking speeds. Inherent advantages of direct injection gasoline engines, such as direct engine start and combustion-assisted engine start, are lost due to low fuel pressure issues at engine starting events. In addition, low fuel pressure in conventional engine start maneuvers may result in several misfire events prior to robust combustion and therefore result in poor engine startability, undesirably increased tailpipe emissions and undesirably decreased fuel economy. Similarly, during fuel/power enrichment maneuvers—especially in E85 spark-ignited direct-injection (SIDI) engines which require higher fuel flow rates due to the relatively lower power density of E85 relative to other fuels—fuel pressure can drastically drop due to transient high fueling rate requirements, resulting in lower power output and higher engine out emission due to inadequate fuel delivery.

Solutions to low fuel pressure include the addition of a second fuel pump. Additional pumps and the machinery required to drive them may be bulky and require a large number of additional parts, exacerbating package space issues, adding unnecessary weight to the vehicle, and adding additional parts that may eventually require service. Additionally, fuel pumps driven by electric motors frequently require a large gear reduction factor in order for both the motor and the fuel pump to operate in normal operating ranges, and such gear reduction devices are typically bulky and require a particular orientation to the attached devices.

SUMMARY

An apparatus for providing pressurized fuel for an engine includes an engine starting apparatus including an electric motor operative to crank the engine and a fuel pump operatively coupled to the electric motor. The electric motor is preferably operable independent from the starting function such that the fuel pump is selectively operable during or independent of engine cranking.

BRIEF DESCRIPTION OF THE DRAWINGS

One or more embodiments will now be described, by way of example, with reference to the accompanying drawings, in which.

DETAILED DESCRIPTION

Figure 1:
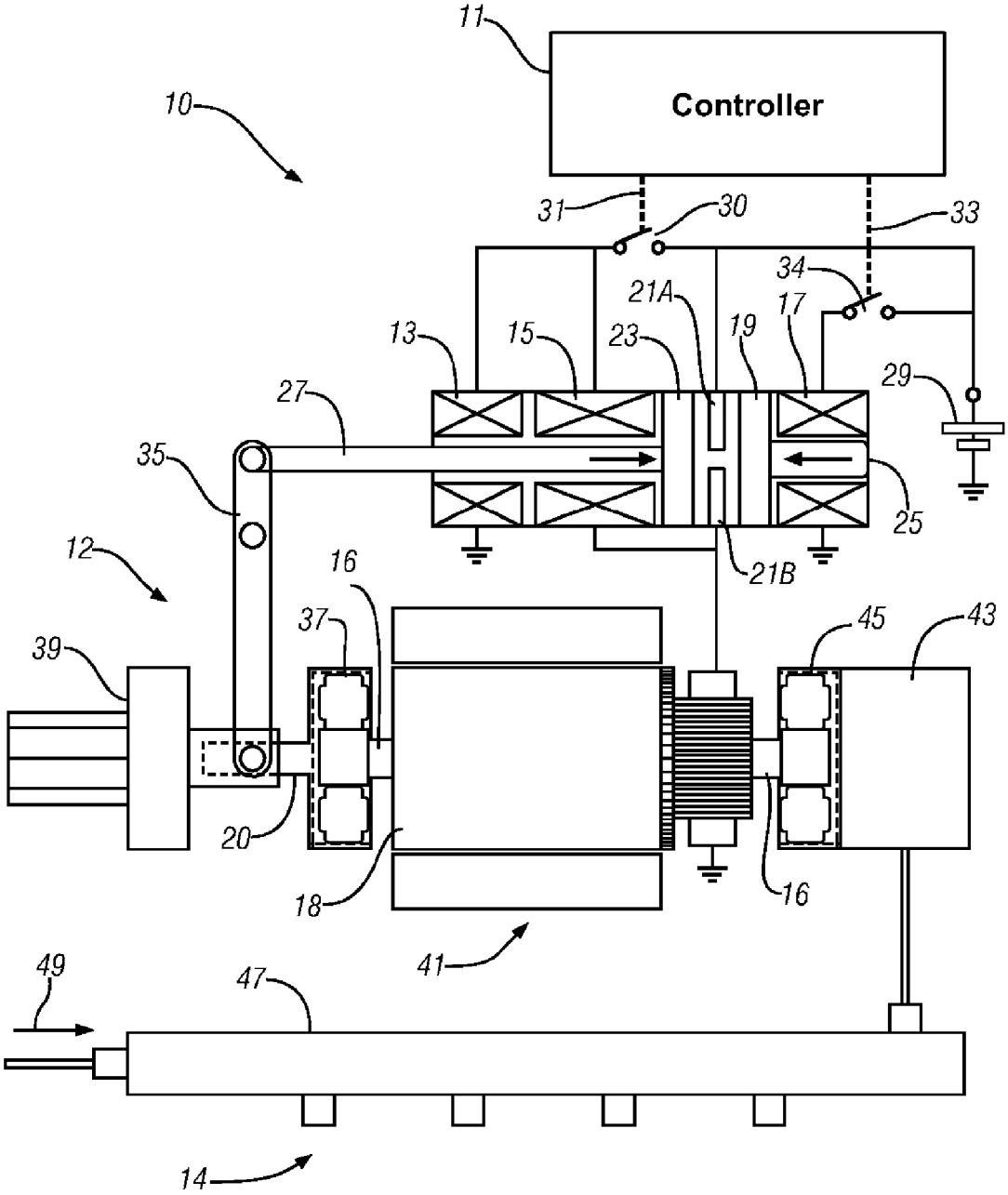
FIG. 1 is a schematic depiction of a fuel pressure boosting apparatus and control in accordance with the present disclosure.

Referring now to the drawings, wherein the showings are for the purpose of illustrating certain exemplary embodiments only and not for the purpose of limiting the same, a fuel pressure boosting apparatus 10 is depicted in FIG. 1 and includes an exemplary engine starting apparatus 12 and exemplary high pressure fuel delivery apparatus 14. The starting apparatus 12 includes electric motor 41. Motor 41 includes armature 18 coupled to motor output shaft 16. Output shaft 16 is coupled to a reduction gearset 37. Gearset 37 has an output shaft 20 which is slidably engaged with pinion gear 39, for example through conventional screw spline coupling. Pinion gear 39 is controllably engaged and disengaged with the engine flywheel, in this particular embodiment, with gear teeth on its outer circumference (not shown) and imparts rotation thereto when engine cranking is desired. Pinion gear 39 also includes an overrun device or one-way clutch to prevent the engine, once started, from back driving the starter motor 41. Alternatively, gearset 37 may be adapted to include such overrun functionality. Pinion gear 39 position is established by mechanical linkages including drive lever 35 and plunger arm 27 coupled to one end thereof. Linear motion of plunger arm 27 is imparted to one end of drive lever 35 which drives the end of drive lever 35 which is coupled to pinion gear 39. Engagement and disengagement of pinion gear 39 with the engine flywheel is therefore controllable in accordance with the linear positioning of plunger arm 27. Plunger arm 27 is biased by a return spring (not shown) toward a disengaged position with respect to the engine flywheel. Plunger arm 27 position is controllable in accordance with a pair of solenoid coils—a pull-in coil 15 and a hold coil 13. Pull-in and hold coils are both initially energized by battery 29 when cranking is called for and plunger 27 moves in the direction of the associated arrow in the figure to effect engagement of the pinion gear 39 with the engine flywheel. Energization of the coils is effected by closure of switch 30 which may take any suitable form including mechanical, electromechanical or solid-state. During engagement motion of the plunger arm 27, motor 41 is powered through pull-in coil 15 to effect a low power rotation during engagement owing to the voltage drop across pull-in coil 15. Once plunger arm 27 is fully engaged, corresponding contact pad 23 bridges contacts 21A and 21B to short pull-in coil 15 and directly couple starter motor 41 to full battery voltage for full power rotation. Continued energization of hold coil 13 maintains engagement of pinion gear 39. Deenergization of hold coil 13 results in release of plunger arm 27 under force of the return spring which opens the contacts 21A and 21B to deenergize the motor 41 and disengage the pinion gear 39 from the flywheel. One having ordinary skill in the art will recognize a number of variations respecting a starter motor arrangement and control as described herein above in the exemplary apparatus. For example, hold-in coil 13 may magnetically latch the plunger arm, the motor 41 may provide direct drive of the flywheel absent any reduction gearset, and different engagement linkages may be employed. Additionally, the switching function provided by contact pad 23 and contacts 21A and 21B may alternatively be provided by a controlled switch such as a controlled electromechanical or solid state switch.

With continued reference to FIG. 1, high pressure fuel delivery apparatus 14 includes high pressure fuel supply 49 from a primary fuel pump (not shown). High pressure fuel is supplied to a high pressure fuel rail 47 which supplies a plurality of fuel injectors (not shown).

In accordance with the present disclosure, a fuel pump in the form of high pressure boost pump 43, which may be a piston-type pump, is coupled to the output shaft 16 of the starter motor 41. In the exemplary embodiment, this coupling is through a reduction gearset 45 and is at the end of the starter motor 41 opposite the pinion gear 39. Any alternative arrangement, including directly driving the high pressure boost pump 43 from the output shaft 16 without an intervening gearset, driving the high pressure boost pump off of a gearset shared with the pinion gear drive, etc., is contemplated. It is only necessary in accordance with the present disclosure that the high pressure boost pump 43 be drivable by the starter motor 41. High pressure boost pump 43 is in fluid communication with the fuel reservoir (not shown) on a suction side thereof and is effective when operative to supply high pressure fuel to fuel rail 47. As can be appreciated from the foregoing description, the high pressure boost pump 43 supplies high pressure fuel to fuel rail 47 any time starter motor 41 is operative. Therefore, during the engagement period of operation when the pull-in 15 and hold 13 coils are energized and during the subsequent engaged period of operation when only the hold coil 13 remains energized, the high pressure boost pump is providing high pressure fuel to fuel rail 47 thereby compensating additively the characteristically low fuel pressure from the cam driven fuel pump during engine cranking. And, once engine ignition has taken hold, engine idle speed attained and cranking is no longer required, further energization of the starter motor 41 is terminated. The termination of starter motor energization ceases forced rotation of the starter motor 41 and disengages the mechanical coupling of the starter motor 41 output shaft 16 and armature 18 from the engine. Therefore, subsequent to engine cranking, the starter motor armature 18 and output shaft 16 remains static. Hence, the high pressure boost pump remains static and is not contributing any parasitic load upon the engine of electrical system of the vehicle.

In accordance with a further embodiment of the disclosure, and one in which additional extended fuel boost functionality is attained, high pressure boost pump is operative by the starter motor 41 independently of the cranking functionality of the starting apparatus 12. Boost coil 17 is controllable to pull plunger arm 25 in the direction of the associated arrow in the figure against the bias of a return spring (not shown). Energization of boost coil 17 is effected by closure of switch 34 which may take any suitable form including mechanical, electromechanical or solid-state. Plunger arm 25 has a corresponding contact pad 19 which is forced into contact with and bridging contacts 21A and 21B. The shorted contact pads 21A and 21B effect the direct coupling of full battery voltage to the starter motor 41 for full power rotation of the armature, output shaft and high pressure boost pump. One having ordinary skill in the art will recognize that the switching function provided by contact pad 19 and contacts 21A and 21B may alternatively be provided by a controlled switch such as a controlled electromechanical or solid state switch. Such an arrangement advantageously makes full use of the significant torque capacity of the and almost instantaneous response of the otherwise unloaded starter motor 41 to provide high pressure fuel to the fuel rail 47 during periods of engine operation. For example, such high pressure boost pump operation may be beneficial during periods of exceptionally significant or sustained periods of fuel consumption, such as during fuel enrichment or heavy loads. As another example, such high pressure boost pump operation may also be beneficial to alleviate anomalous operation of the primary cam driven fuel pump. In other words, a system so mechanized with a high pressure boost pump advantageously enables continued operation, perhaps at decreased levels of performance, of the engine in the event of an improperly operative (e.g. low pressure) or wholly inoperative high pressure fuel supply 49 to the fuel rail 47.

Preferably, the control of switches 30 and 34, as well as any alternative implementations of the functionality of contact pads 23 and 19 and contacts 21A and 21B, is by way of computer based controller 11 as illustrated with respect to switches 30, 34 by respective control lines 31, 33. Controller 11 is preferably a general-purpose digital computer including a microprocessor or central processing unit, read only memory (ROM), random access memory (RAM), electrically programmable read only memory (EPROM), high speed clock, analog to digital (A/D) and digital to analog (D/A) circuitry, and input/output circuitry and devices (J/O) and appropriate signal conditioning and buffer circuitry. The controller has a set of control routines, comprising resident program instructions and calibrations stored in ROM.

Routines for engine control, including cranking, are typically executed during preset loop cycles such that each algorithm is executed at least once each loop cycle. Routines stored in the non-volatile memory devices are executed by the central processing unit and are operable to monitor inputs from sensing devices and execute control and diagnostic routines to control operation of the engine using preset calibrations. Loop cycles are typically executed at regular intervals, for example each 3.125, 6.25, 12.5, 25 and 100 milliseconds during ongoing engine operation. Alternatively, algorithms may be executed in response to occurrence of an event or interrupt request such as, for example, operator request for engine ignition.

Figure 2:
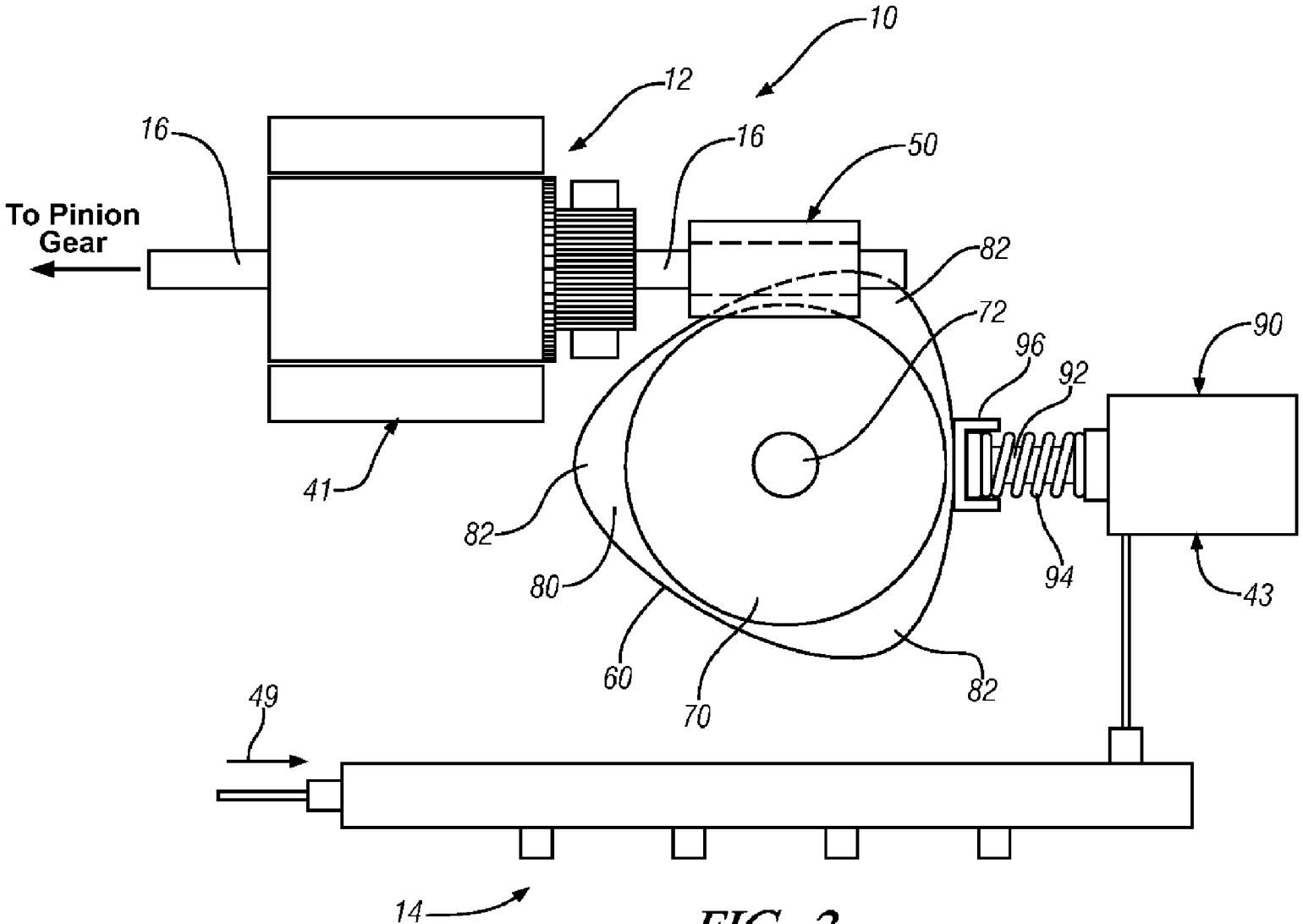
FIG. 2 is a schematic depiction of a fuel pressure boosting apparatus utilizing a cam and worm gear assembly in accordance with the present disclosure.
Figure 3:
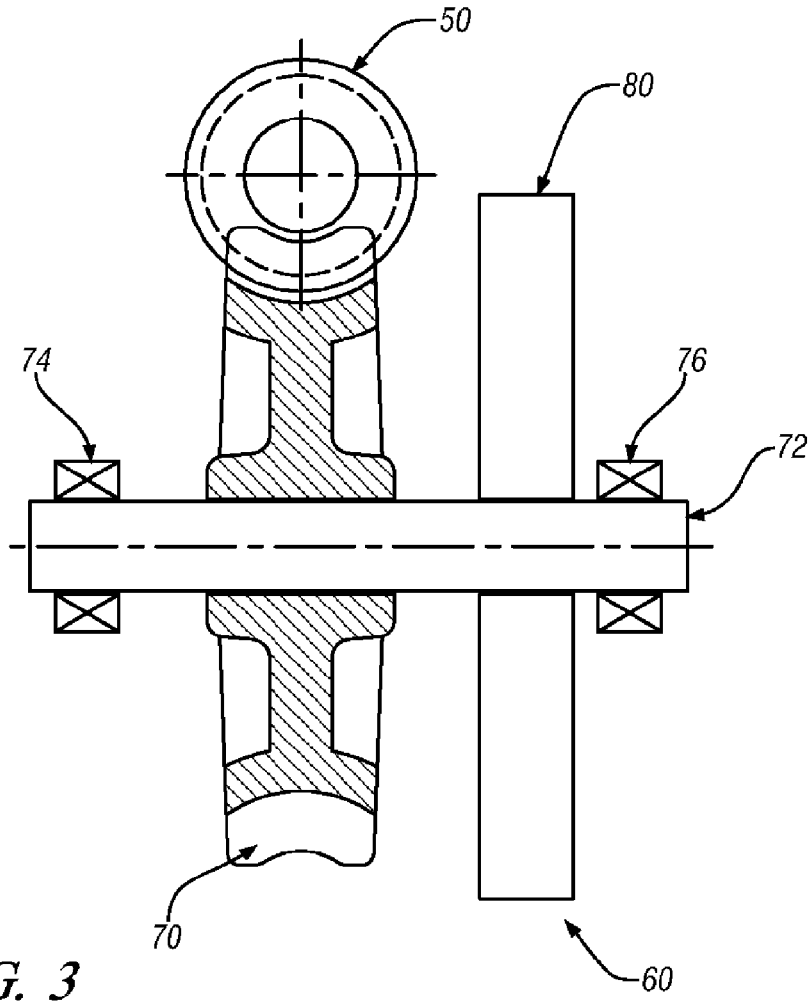
FIG. 3 is a cross-sectional depiction of a cam and worm gear assembly in accordance with the present disclosure.

As previously described, high pressure boost pump 43 is coupled to output shaft 16 of starter motor 41. In one exemplary embodiment as depicted in FIG. 1, this coupling is through reduction gearset 45 and is at the end of starter motor 41 opposite pinion gear 39. The use of reduction gearset 45 enables the use of a known starter motor that runs at a high speed with a known fuel pump that runs at a low speed by introducing a gear reduction factor. However, many embodiments of reduction gearset 45 require significant package space and must be located proximately to starter motor 41 and output shaft 16. Package space within an engine compartment and particularly in close proximity to starter motor 41 is not always readily available and may pose serious engine design issues. FIGS. 2 and 3 illustrate an exemplary embodiment that utilizes a cam and worm wheel assembly 60 in place of reduction gearset 45 in order to accomplish the gear reduction factor described above while gaining flexibility in package space. However, it will be appreciated that many alternative embodiments of reduction gearset 45 are contemplated, including common gears and planetary gear sets well known in the art.

FIG. 2 illustrates an exemplary fuel pressure boosting apparatus 10, including engine starting apparatus 12, high pressure boost pump 43 in the form of piston pump 90, high pressure fuel delivery apparatus 14, and cam and worm wheel assembly 60. Cam and worm wheel assembly 60 includes a worm wheel 70, a cam 80, and a shaft 72. Electric motor 41 of engine starting apparatus 12 turns a worm 50 which, in this particular embodiment, is fixedly attached to output shaft 16. It will be appreciated that worm 50 may be attached to output shaft 16, or worm 50 may exist on its own shaft, coupled to output shaft 16 through some coupling device. Worm 50 uses spiral threading around a cylindrical core and mechanically interacts with worm wheel 70 such that as output shaft 16 turns, worm 50 turns worm wheel 70.

Worm gear mechanisms such as the one utilized the exemplary system of FIG. 2 are especially advantageous for use in applications requiring high gear reduction factors and also requiring package space flexibility. Those having ordinary skill in the art will appreciate that worm gears are known to accomplish high gear reduction factors. Also, worm 50 is a compact component and may be only relatively minimally larger than the shaft on which it is mounted, and worm wheel 70 can be flexibly located in any orientation around the worm that supports the mechanical contact between worm 50 and worm wheel 70. As a result of these features of the worm gear design which accommodate gear reduction and package space issues, the connection of high pressure boost pump 43 to starter motor 41 in close proximity to the engine block and other large, immovable engine components and the gear reducing function inherent to a worm gear are made possible.

Worm 50 and worm wheel 70 accomplish the transmission of torque and provide a gear reduction factor for the purpose of driving high pressure boost pump 43. The torque provided through worm wheel 70 may be utilized in a number of ways. In the exemplary embodiment depicted in FIG. 2, worm wheel 70 is attached to shaft 72 for the purpose of transferring torque from worm 50 to some fuel pump driving mechanism, in this case, cam 80. FIG. 3 depicts an exemplary embodiment whereby cam and worm wheel assembly 60 is held in contact with worm 50. Shaft 72 is axially held in place by bearings 74 and 76 and is allowed to rotate. Cam 80 is fixedly attached to shaft 72, such that when worm wheel 70 is turned by worm 50, shaft 72 spins, causing cam 80 to spin in unison with worm wheel 70. Returning to FIG. 2, cam 80 is a rotating disk and is well known in the art. Cam 80 is formed in shape such that, as cam 80 spins, lobes 82 on the circumference of cam 80 spin around the center of cam 80. Lobes 82 interact with piston pump 90 to drive the piston mechanism in and out, thereby powering piston pump 90. Cams may utilize a single lobe, for example, as is widely used in camshaft applications, or cams may utilize a plurality of lobes. Cam 80 utilized in this exemplary embodiment utilizes three lobes 82. In this particular exemplary embodiment of piston pump 90, the piston mechanism includes piston 92, piston spring 94, and flat face plate 96. Flat face plate 96 is located such that the lobes 82 around the circumference of cam 80 interact with and push outward with each lobe 82 on flat face plate 96 as cam 80 spins. Flat face plate 96 is attached to piston 92, which axially transfers force from flat face plate 96 to the internal mechanisms of piston pump 90 to perform fuel pumping work. Piston 92 and flat face plate 96 are biased towards an out position by piston spring 94 which is located around piston 92 and is compressed between flat face plate 96 and the body of piston pump 90. The bias of piston spring 94 is counteracted by lobes 82 rotating around the circumference of cam 80, causing the in and out motion described above used to power piston pump 90. In this way, cam and worm wheel assembly 60 transfers power from high speed output shaft 16 to piston pump 90, utilizing different package space options and accomplishing the gear reduction factor required to utilize piston pump 90. It will be appreciated by those having ordinary skill in the art that a multitude of arrangements for converting the high speed output shaft 16 into a low speed input for a fuel pump may be utilized with different package space effects, and the disclosure is not intended to be limited to the embodiments listed herein.

Figure 4:
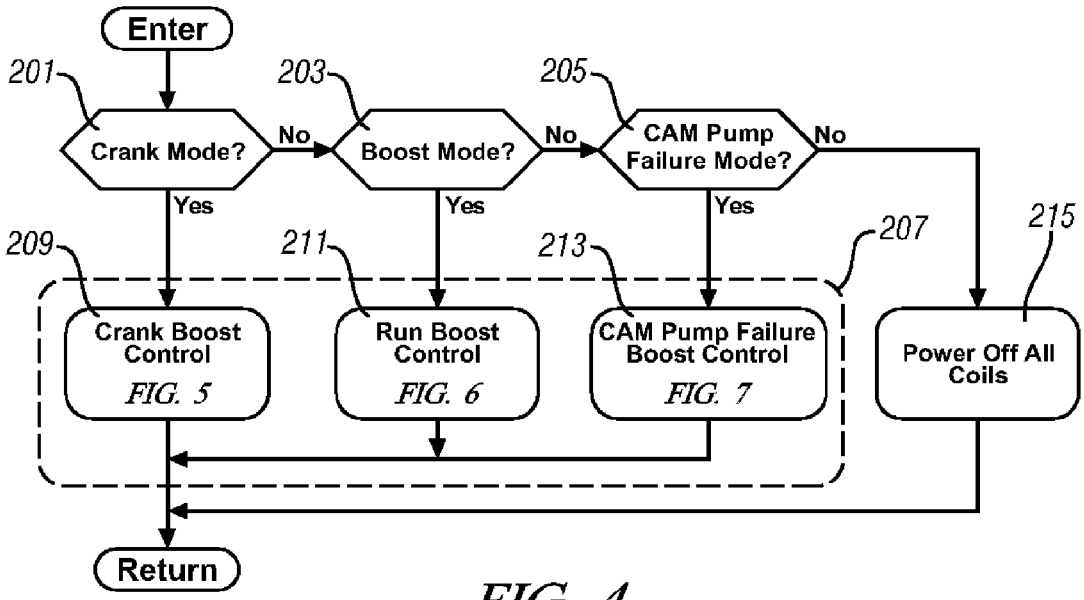
FIG. 4 is a high level control routine depicting fuel pressure boosting control during certain exemplary engine operating scenarios in accordance with the present disclosure.

Having thus described operative embodiments for effecting fuel boost, the remaining FIGS. 4 through 7 are now referenced and depict exemplary routines suitable for execution by controller 11 in carrying out certain functions in accordance with the present disclosure. FIG. 4 depicts a high level control routine for fuel pressure boosting control during certain exemplary engine operating scenarios in accordance with the present disclosure as implemented in conjunction with the exemplary apparatus herein before described. The routine determines through logical decisions at blocks 201 through 205 whether a mode of engine operation or control requires operation of the high pressure boost pump and attendant fuel pressure boost through execution of an appropriately more detailed boost control routine 207. Where no call for high pressure boost pump operation is required, block 215 is executed whereat all coils 13, 15 and 17 are deenergized by deactivation or opening of switches 30 and 34.

The three exemplary scenarios illustrating the utility of the disclosure and demonstrative of various inventive control aspects are respectively illustrated in decision blocks 201, 203, and 205 and corresponding detailed boost routines 209, 211, and 213, respectively. In a first scenario of desired high pressure boost pump operation when engine cranking is desired or active in accordance, for example, with operator initiation or subsequent controller crank operation, decision block 201 would pass control to crank boost control routine further illustrated in FIG. 5. Similarly, in a second scenario of desired high pressure boost pump operation when the engine is running and fuel enrichment is desired in accordance, for example, with vehicle throttle pedal position, decision block 203 would pass control to run boost control routine further illustrated in FIG. 6. And, in a third scenario of desired high pressure boost pump operation when engine operation is desired in accordance, for example, with a diagnosed faulty cam driven pump or low pressure fuel supply, decision block 205 would pass control to run boost control routine further illustrated in FIG. 7.

Figure 5:
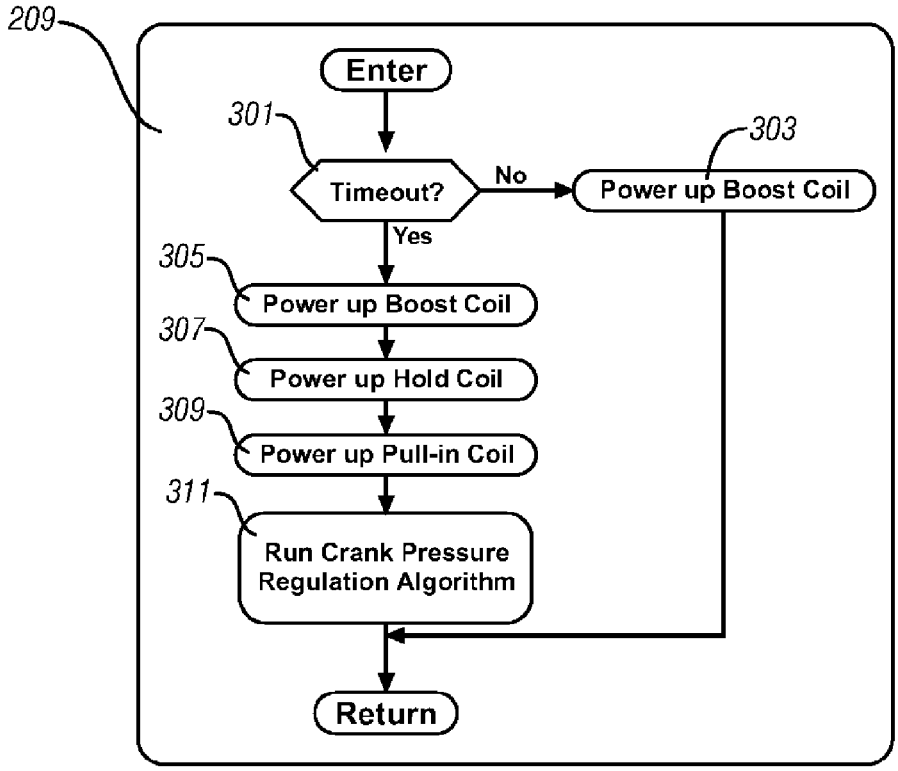
FIG. 5 is a more detailed depiction of a control routine depicting fuel pressure boosting control in conjunction with engine cranking in accordance with the present disclosure.

Taking the first exemplary scenario of high pressure boost pump operation during engine cranking described above as boost routine 209 and with more particular reference to FIG. 5, an exemplary routine for execution by controller 11 includes a determination at block 301 to provide an initial period at the inception of the engine cranking control during which the high pressure boost pump is caused to spin up and establish pressure. Therefore, if this initial timeout period has not expired, block 301 passes control to block 303 whereat only the boost coil 17 is energized to establish adequate pressure in the fuel rail prior to engine cranking. Subsequent to block 303, the routine is exited. When the initial timeout period has expired, block 301 passes control to block 305 whereat the boost coil is deenergized since continued energization will no longer be required to maintain the rotation of the high pressure boost pump in accordance with the subsequently illustrated blocks to be described. Subsequently, the hold and pull-in coils are energized at blocks 307 and 309 to effect engine cranking and the continued operation of the high pressure boost pump. Block 311 next represents fuel pressure regulation as may be implemented, for example, by way of pressure bleed off and fuel return to the fuel reservoir to maintain a desired fuel rail pressure. Subsequently, the routine is exited. When cranking is no longer desired, and assuming other high pressure boost pressure operational modes are not called for, block 215 of FIG. 4 will effect deenergization of all coils resulting in the termination of pinion to flywheel engagement and starter motor rotation.

Figure 6:
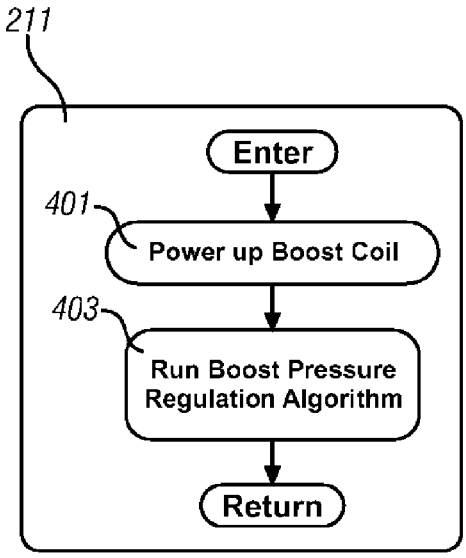
FIG. 6 is a more detailed depiction of a control routine depicting fuel pressure boosting control in conjunction with engine running in accordance with the present disclosure.

Taking next the second exemplary scenario of high pressure boost pump operation during engine operation described above as boost routine 211 and with more particular reference to FIG. 6, an exemplary routine for execution by controller 11 includes block 401 whereat only the boost coil 17 is energized to establish pressure in the fuel rail in conjunction with the pressure being established independently by the cam driven fuel pump. Block 401 passes control to block 403 which represents fuel pressure regulation as may be implemented, for example, by way of pressure bleed off and fuel return to the fuel reservoir to maintain a desired fuel rail pressure. Subsequently, the routine is exited. When boosting fuel pressure by the high pressure boost pump is no longer desired, and assuming other high pressure boost pressure operational modes are not called for, block 215 of FIG. 4 will effect deenergization of all coils resulting in the termination of starter motor rotation and high pressure boost pump operation.

Figure 7:
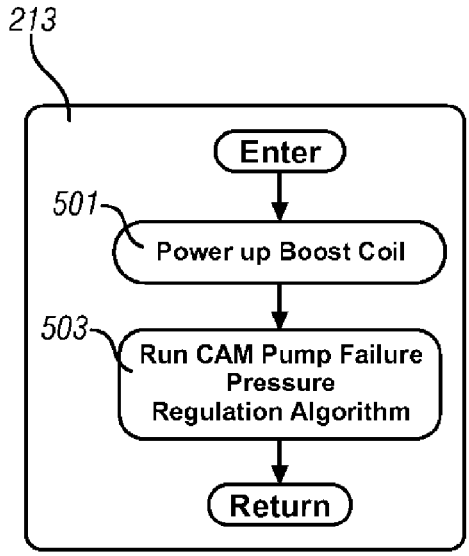
FIG. 7 is a more detailed depiction of a control routine depicting fuel pressure boosting control in conjunction with a failed cam pump in accordance with the present disclosure.

Taking next the third exemplary scenario of high pressure boost pump operation during engine operation in response to diagnosis of a faulty cam driven pump described above as boost routine 213 and with more particular reference to FIG. 7, an exemplary routine for execution by controller 11 includes block 501 whereat only the boost coil 17 is energized to establish pressure in the fuel rail in conjunction with the pressure being established independently by the cam driven fuel pump, which pressure has been diagnosed as being inadequate. Block 501 passes control to block 503 which represents fuel pressure regulation as may be implemented, for example, by way of pressure bleed off and fuel return to the fuel reservoir to maintain a desired fuel rail pressure. Subsequently, the routine is exited. When boosting fuel pressure by the high pressure boost pump is no longer desired, and assuming other high pressure boost pressure operational modes are not called for, block 215 of FIG. 4 will effect deenergization of all coils resulting in the termination of starter motor rotation and high pressure boost pump operation.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus for providing pressurized fuel for an engine, comprising:

a primary fuel pump configured to supply high pressure fuel to a fuel rail;

an engine starting apparatus including an electric motor rotatably coupled to a pinion gear which is selectively engaged and disengaged with a flywheel of said engine;

a high pressure boost pump rotatably coupled to the electric motor and configured to supply high pressure fuel to a the fuel rail when the electric motor is rotating; and a control apparatus means for effecting rotation of the electric motor and boost pump while maintaining disengagement of the pinion gear from the flywheel of said engine for a period of time when the engine is not running prior to cranking sufficient to establish pressure in the fuel rail from the boost pump and subsequent to said period of time additionally engaging the pinion gear with the flywheel of said engine when sufficient pressure in the fuel rail has been reached to crank the engine.

2. The apparatus of claim 1, wherein said control means further selectively effects rotation of the electric motor and boost pump to establish pressure in the fuel rail from the boost pump when fuel enrichment to said engine is desired subsequent to engine cranking during engine operation.

3. The apparatus of claim 1, wherein said control means further selectively effects rotation of the electric motor and boost pump to establish pressure in the fuel rail from the boost pump when inadequate pressure is established by the primary fuel pump subsequent to engine cranking during engine operation.

4. The apparatus of claim 2, wherein said control means further selectively effects rotation of the electric motor and boost pump to establish pressure in the fuel rail from the boost pump when inadequate pressure is established by the primary fuel pump subsequent to engine cranking during engine operation.

5. An apparatus for providing pressurized fuel for an engine, comprising:

a primary fuel pump configured to supply high pressure fuel to a fuel rail;

an engine starting apparatus including an electric motor rotatably coupled to a pinion gear which is controllably engaged and disengaged with a flywheel of said engine;

a high pressure boost pump rotatably coupled to the electric motor and configured to supply high pressure fuel to a the fuel rail when the electric motor is rotating;

a starter plunger arm linked to the pinion gear and having a first starter plunger arm position wherein the pinion gear is engaged with the flywheel of the engine and a second starter plunger arm position wherein the pinion gear is disengaged from the flywheel of the engine;

a pull-in coil and a hold coil configured to urge the starter plunger arm toward the first starter plunger arm position when energized;

switch contacts configured when closed to couple the electric motor to a voltage source and cooperatively configured with the starter plunger arm to be closed when the starter plunger arm is in the first starter plunger arm position and to be open when the starter plunger arm is not in the first starter plunger arm position;

a boost plunger arm having first and second boost plunger arm positions, the switch contacts cooperatively configured with the boost plunger arm to be closed when the boost plunger arm is in the first boost plunger arm position and to be open when the boost plunger arm is not in the first boost plunger arm position;

a boost coil configured to urge the boost plunger arm toward the first boost plunger arm position when energized; and a control means for energizing the boost coil to rotate the electric motor and boost pump for a period of time when the engine is not running prior to cranking sufficient to establish pressure in the fuel rail from the boost pump and prior to additionally energizing the pull-in and hold coils to engage the pinion gear with the flywheel of the engine when sufficient pressure in the fuel rail has been reached to crank the engine.

6. The apparatus of claim 5, wherein said control means further selectively energizes the boost coil to rotate the electric motor and boost pump to establish pressure in the fuel rail from the boost pump when fuel enrichment to said engine is desired subsequent to engine cranking during engine operation.

7. The apparatus of claim 5, wherein said control means further selectively energizes the boost coil to rotate the electric motor and boost pump to establish pressure in the fuel rail from the boost pump when inadequate pressure is established by the primary fuel pump subsequent to engine cranking during engine operation.

8. The apparatus of claim 6, wherein said control means further energizes the boost coil to rotate the electric motor and boost pump to establish pressure in the fuel rail from the boost pump when inadequate pressure is established by the primary fuel pump subsequent to engine cranking during engine operation.

9. A method for providing pressurized fuel to a fuel rail of an engine from a fuel pump coupled to a starter motor, the starter motor fixedly coupled to the fuel pump and selectively engageable with a flywheel of the engine to effect engine cranking, comprising:

rotating the starter motor for a period of time when the engine is not running prior to cranking sufficient to establish pressure in the fuel rail from the fuel pump and subsequently additionally engaging the starter motor with the flywheel of said engine when sufficient pressure in the fuel rail has been reached to crank the engine.

10. The method of claim 9, further comprising rotating the starter motor and boost pump to establish pressure in the fuel rail from the boost pump when fuel enrichment to said engine is desired subsequent to engine cranking during engine operation.

11. The method of claim 9, further comprising rotating the starter motor and boost pump to establish pressure in the fuel rail from the boost pump when inadequate pressure is established by a primary fuel pump subsequent to engine cranking during engine operation.

12. The method of claim 11, further comprising rotating the starter motor and boost pump to establish pressure in the fuel rail from the boost pump when inadequate pressure is established by a primary fuel pump subsequent to engine cranking during engine operation.

* * * * *